United States Patent [19]

Mawby et al.

[11] Patent Number: 4,628,699

[45] Date of Patent: Dec. 16, 1986

[54] ICE MAKER

[75] Inventors: Harold S. Mawby, Belding; Duane H. Harris, Gowen, both of Mich.

[73] Assignee: White Consolidated, Inc., Cleveland, Ohio

[21] Appl. No.: 722,135

[22] Filed: Apr. 11, 1985

[51] Int. Cl.[4] ..... F25C 1/00

[52] U.S. Cl. ..... 62/137; 62/344

[58] Field of Search ..... 62/137, 344; 340/612, 340/617, 615; 200/61.2, 61.21; 222/64

[56] References Cited

U.S. PATENT DOCUMENTS

| | | | |
|---|---|---|---|
| 2,982,111 | 5/1961 | Dahl | 62/137 |
| 3,055,184 | 9/1962 | Linstromberg | 62/137 |
| 3,234,750 | 2/1966 | Swanson | 62/137 |
| 3,581,516 | 6/1971 | Buchser et al. | 62/137 |
| 3,863,461 | 2/1975 | Bright | 62/137 |
| 3,926,007 | 12/1975 | Braden et al. | 62/137 |

*Primary Examiner*—William E. Wayner

*Attorney, Agent, or Firm*—Pearne, Gordon, Sessions, McCoy, Granger & Tilberry

[57] ABSTRACT

A low cost automatic ice cube maker of simplified construction for use in the freezer compartment of a domestic refrigerator. The ice maker includes a one-piece, molded plastic bail or sensing arm for monitoring the level of ice cubes in an underlying storage bin. The movable bail includes a fingerlike resilient projection extending radially from one of the end portions of the bail. The distal end of the projection engages a portion of the ice maker fixed in position relative to the movable bail wherein the resilient projection functions as a springlike member biasing the bail toward a lowermost position. The ice maker also includes a pivotally mounted ice tray that can be easily snapped out of its ice making position for removal and cleaning at a location outside the freezer compartment. An externally accessible mechanism for actuating a test switch of the internal control circuit of the ice maker is provided to facilitate servicing of the ice maker.

7 Claims, 21 Drawing Figures

ICE MAKER

BACKGROUND OF THE INVENTION

The present invention relates in general to ice making, and more particularly to an automatic ice cube maker for use in the freezer compartment of a domestic refrigerator.

U.S. Pat. Nos. 4,142,373; 4,142,377 and 4,142,378, all owned by the assignee of the present invention and incorporated by reference herein in their entireties, illustrate a prior art automatic ice cube maker of the particular type to which the present invention is directed.

Such a prior art automatic ice maker includes a housing having a generally open top and bottom defined by a front wall, a rear wall, and a pair of opposed sidewalls. A rectangular, flexible plastic ice tray has a top side providing a plurality of ice cube shaped pockets for receiving from a fill tube located above the ice tray, water to be frozen into ice cubes. The rectangular ice tray is pivotally mounted at its ends between the front and rear housing walls for rotary movement on a horizontal axis. An electric motor, through a reduction gear type transmission, moves the ice tray between an upright ice making position and an inverted ice dumping position. When the ice tray moves to its inverted ice dumping position, ice cubes are dislodged by limited twisting of the flexible tray, and then fall from the ice tray into an underlying, open top, ice cube storage bin. The ice cubes in the bin can be manually removed, or can be automatically dispensed through the closed door of the freezer compartment via a through-the-door ice dispenser is disclosed in U.S. Pat. No. 4,220,266, also owned by the assignee of the present invention. An example of an ice cube storage bin for use with an automatic through-the-door ice dispenser is illustrated by U.S. Pat. No. 3,887,119, also owned by the assignee of the present invention.

An electronic control circuit regulates the operation of the electric motor driving the ice tray. The control circuit is responsive to a probelike sensor monitoring the temperature of a selected one of the ice cube pockets in the ice tray. The control circuit is also responsive to the position of a movable ice level sensing arm or bail that swings downwardly into the open top of the storage bin to monitor the level of ice cubes accumulated therein. When the ice level in the bin holds the movable bail at a predetermined raised position indicative of a desired maximum ice level, the control circuit inhibits movement of the ice tray to its inverted ice dumping position so as to avoid overfilling of the ice storage bin. The noted prior art ice maker also includes a torsion spring rod mechanism that automatically moves the bail to its raised, ice dump inhibiting position when the storage bin is temporarily removed from the freezer compartment, thus precluding ice dumping during the time period that the bin is removed.

Although the noted prior art ice maker represents a significant advancement in the art, it has been found to be relatively costly to manufacture. Also, it is relatively complex, thus leading to reliability and maintenance problems. These disadvantages are especially significant due to the highly competitive nature of the domestic appliance industry where cost and long term reliability are of paramount concern.

It would be desirable to provide an improved automatic ice maker of the subject type but of simpler, lower cost construction, while not forfeiting any benefits of prior art devices. Further, such an improved ice maker design should, to the extent possible, facilitate serviceability of the ice maker so as to minimize maintenance costs.

SUMMARY OF THE INVENTION

In accordance with the present invention, a low cost automatic ice cube maker of simplified construction is provided for use in the freezer compartment of a domestic refrigerator.

The ice maker includes a housing member having a generally open top and bottom defined by a front wall, a rear wall, and a pair of opposed sidewalls.

A compartmented ice tray has a top side constituted by a plurality of ice shaped pockets for receiving water to be frozen, the ice tray being horizontally mounted within the walls of the housing for movement between an upright ice making position and an inverted ice dumping position.

An electrically energized drive means, regulated by an electronic control circuit, is connected to the ice tray for moving the ice tray between its upright and inverted positions.

A movable ice level sensing member is located below the ice tray, and is pivotally mounted to the housing for oscillatory movement on a horizontal axis. The sensing member is engageable with the upper level of temporarily stored ice cubes accumulating at a generally fixed location below the ice maker, the sensing member moving towards and away from the ice tray as the raising and lowering of the level of stored ice cubes occurs.

The sensing member actuates a switch portion of the electronic control circuit when the sensing member moves towards the ice tray to a predetermined position indicative of a maximum raised ice level. Movement of the ice tray to its inverted ice dumping position is inhibited by the control circuit switch portion until the sensing member moves away from the ice tray to a position indicative of a lowermost ice level.

The sensing member is constituted by a one-piece, elongated bail formed of molded plastic material, the bail having end portions located on the said horizontal axis, and a curved intermediate portion radially spaced from the said horizontal axis. The cross-sectional area of the bail along its extent is greatest at its intermediate portion to provide mechanical strength. A biasing means constituted by a fingerlike projection integrally formed with and extending from one end of the bail, tends to move the bail toward its lowermost position. A manually actuated detent means located at the other end of the bail takes the place of the earlier noted prior art torsion spring rod mechanism and is used to retain the bail in a raised position to preclude ice cube dumping by the ice maker when the underlying ice cube storage bin is temporarily removed.

In addition to the improved ice sensing bail noted above, improved means for pivotally mounting the ice tray allows for easy removal of the tray so that it can be thoroughly cleaned at a location outside of the freezer compartment.

Finally, a novel mechanism is provided to enhance the serviceability of the ice maker, the mechanism being in the form of a button member formed of electrical insulating material. The rear wall of the ice maker housing is hollow, and contains the ice maker electronic control circuit and drive means. The button member is slidably mounted in an aperture in one of the faces of the hollow rear wall. When the button member is depressed, its inner end engages and actuates a test switch member of the control circuit so as to initiate an ice harvesting or ice dumping cycle which can then be observed to determined proper operation of the ice maker.

BRIEF DESCRIPTION OF THE DRAWINGS

A fuller understanding of the invention may be had by referring to the following description and claims taken in conjunction with the accompanying drawings wherein:

DETAILED DESCRIPTION OF THE PREFERRED EMBODIMENT

Figure 2:
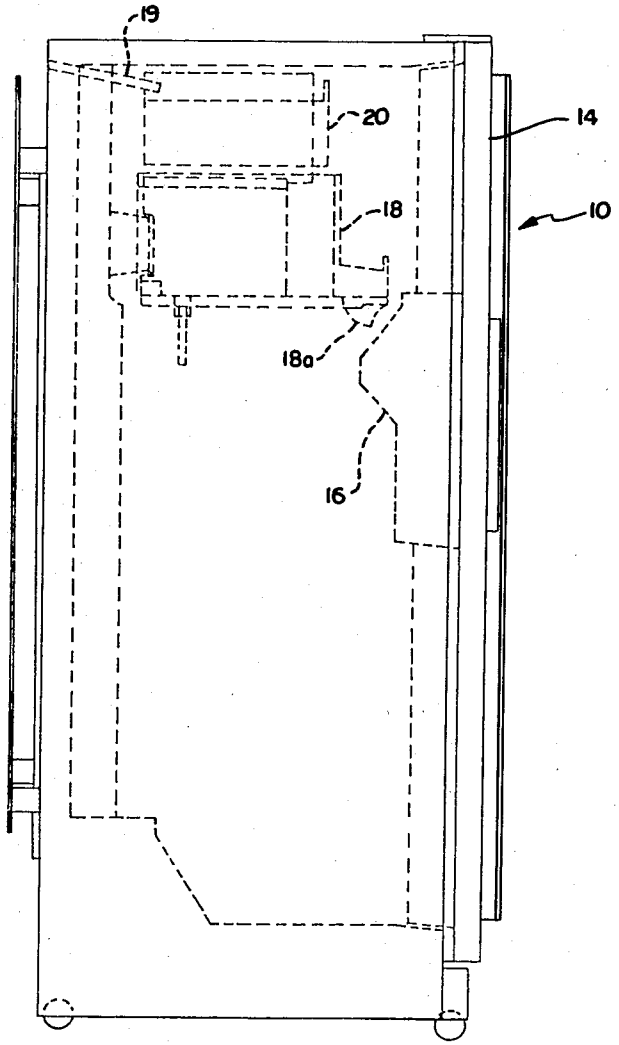
FIG. 2 is a left side elevation view of the refrigerator of FIG. 1.
Figure 1:
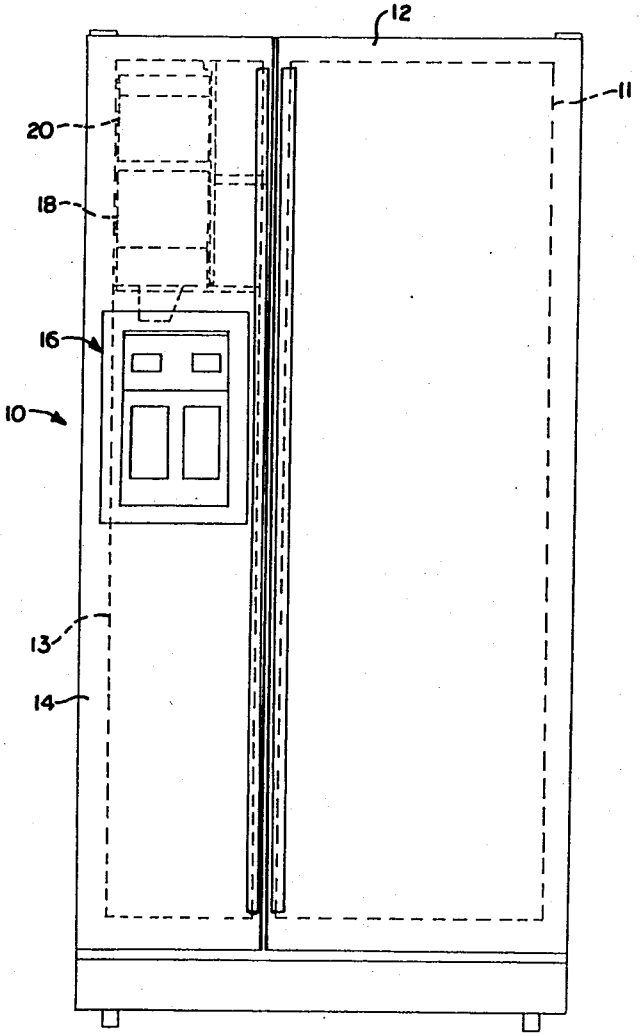
FIG. 1 is a front elevation view of a conventional side-by-side refrigerator of the domestic type having a freezer compartment containing an automatic ice maker in accordance with the present invention.

Referring now to the drawings and more particularly to FIGS. 1 and 2, a side-by-side, frost-free refrigerator 10 of the domestic or household type is illustrated. The refrigerator 10 includes a relatively large refrigerator compartment 11 (shown in phantom) accessible via an outwardly opening, vertically hinged refrigerator door 12. The door 12 is hinge-mounted along its right side as illustrated in FIG. 1. The refrigerator compartment 11 is used in a conventional manner to store food at a temperature below ambient, but above freezing. Separate from, but adjacent to, the refrigerator compartment 11 is a smaller freezer compartment 13 (shown in phantom) accessible via an outwardly opening, vertically hinged freezer door 14. The door 14 is hinge-mounted along its left side as illustrated in FIG. 1. The freezer compartment 13 is used in a conventional manner to store food at a temperature below freezing.

The refrigerator 10 includes a through-the-door chilled water and ice dispenser 16 of a conventional type, the dispenser 16 being mounted on and being movable with the freezer door 14. With the freezer door 14 closed as illustrated, the user can place a container, such as a water glass, at either of two predetermined recessed positions within the ice dispenser 16, and actuate an associated one of two available pushbutton type switch pads wherein either chilled water or ice cubes are fed via the dispenser 16 into the glass.

With particular reference to FIG. 2, ice cubes are provided to the dispenser 16 by an open top ice cube storage bin 18 having an ice chute 18*a* at its forward end for providing ice cubes that, in effect, drop through the door into the user's glass via the dispenser 16. An improved ice storage bin for use in conjunction with the present invention is disclosed in pending U.S. patent application Ser. No. 654,233 filed on Sept. 25, 1984 by the assignee of the present invention.

In accordance with the present invention, an automatic ice maker 20 of simplified construction provides generally cube-shaped ice pieces that drop into the open top of the storage bin 18 where they are temporarily stored until fed out of the chute 18*a* to the dispenser 16. Water is supplied to the ice maker 20 by a conventional, solenoid valve controlled, fill tube 19 as will be subsequently illustrated and discussed in greater detail. The illustrated configuration of the dispenser 16, the storage bin 18, the fill tube 19, and the automatic ice maker 20 is well known in the art.

Figure 3:
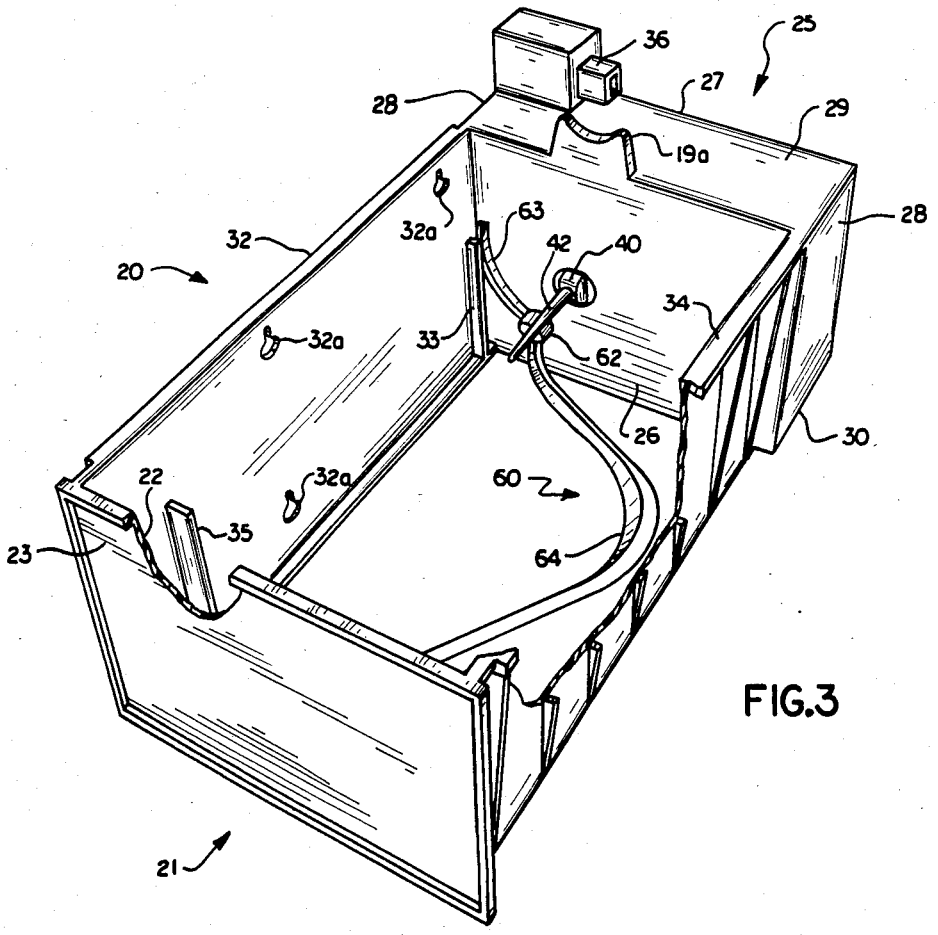
FIG. 3 is a frontal perspective view of the ice maker in accordance with the present invention with portions cut away, and with its ice tray removed.
Figure 4:
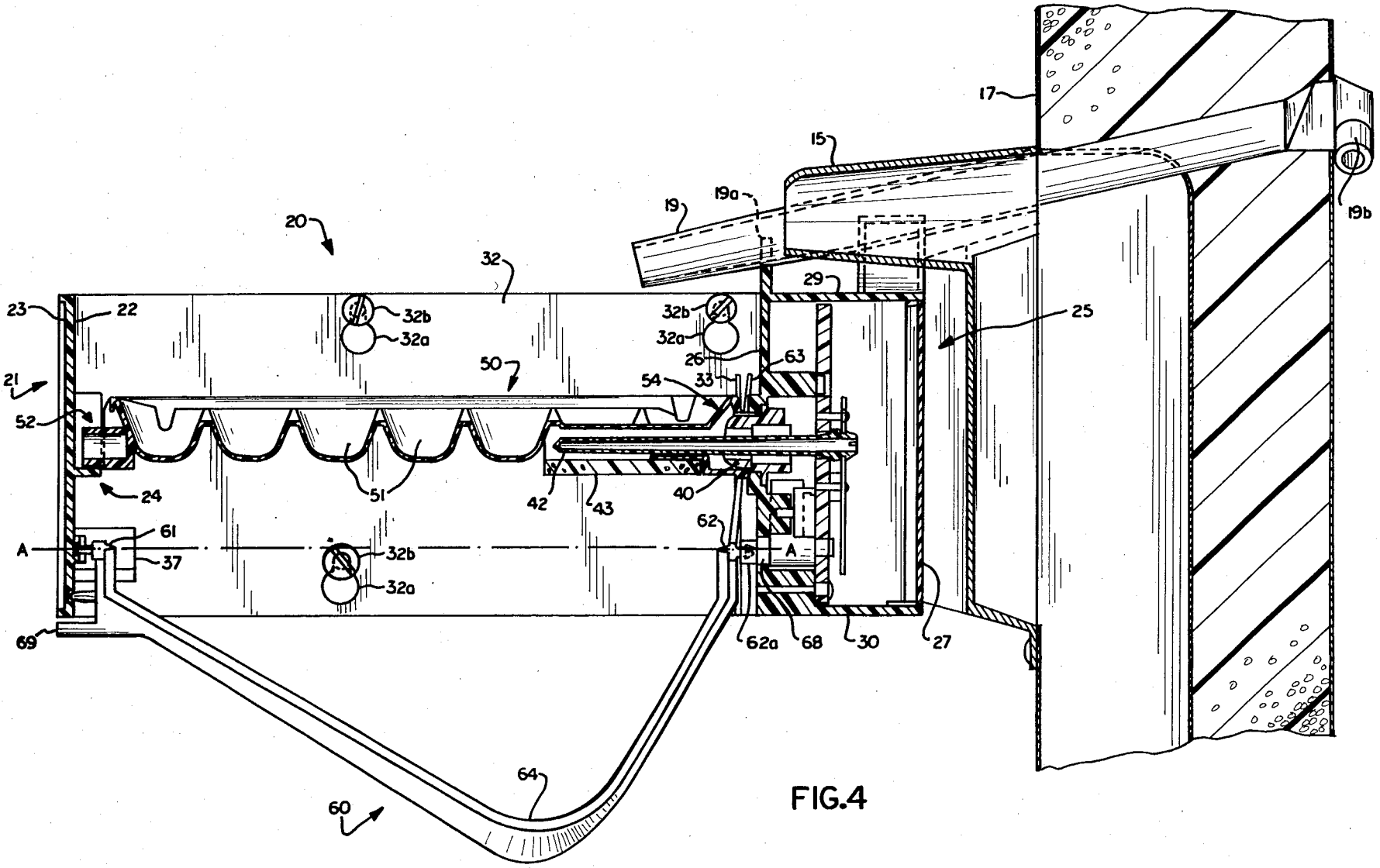
FIG. 4 is a longitudinal cross-section view of the ice maker mounted in the freezer compartment of the associated refrigerator illustrated in FIGS. 1 and 2.

With reference to FIGS. 3 and 4, the automatic ice maker 20 includes a rectangular housing member formed of molded plastic material, the housing member having a generally open top and bottom defined by a front wall 21, a hollow rear wall 25, a left sidewall 32 and an opposed right sidewall 34. The front wall 21 has an inner side or face 22 and an outer side or face 23. The hollow rear wall 25 has a front face 26, a rear face 27, a pair of opposed side faces 28, a top face 29 and a bottom face 30. The faces 26, 27, 28, 29, 30 of the hollow rear wall 25 define an interior volume which contains an electronic control circuit and an electric motor type drive means for rotating back-and-forth in oscillatory fashion an ice tray 50 (see FIG. 4) of the ice maker as will be subsequently illustrated. An electrical connector 36 (see FIG. 3) is located on the top face 29 of the rear wall 25, electrical power being supplied to the ice maker 20 by way of the connector 36. The fill tube 19

(see FIG. 4) for providing water to the ice maker 20 is supported upon a fill tube pedestal 19*a* which extends upwardly from a forward portion of the top face 29 as illustrated. The downwardly slanting distal end of the fill tube 19 rests on the pedestal 19*a*, the tube 19 extending through a rear wall portion 17 of the freezer compartment for connection to a water supply line by means of a nipple portion 19*b* of the fill tube 19.

With particular reference to FIG. 4, the ice maker 20 can be seen to include the horizontally extending, compartmented ice tray 50 having a top side providing a plurality of ice cube forming pockets 51. The ice tray 50 is formed of flexible plastic material and is pivotally mounted at its ends between the front wall 21 and the front face 26 of the rear wall 25 as illustrated. As shown in FIG. 4, the ice tray 50 is at its upright ice making position wherein a controlled amount of water poured into the tray 50 via the fill tube 19 will, over a period of time freeze to form ice cubes. As is well known in the art, when such ice cubes are formed and when a demand for such ice cubes exists, the tray 50 will rotate to a generally inverted ice dumping position wherein ice cubes are dislodged from the ice tray 50 by flexing or longitudinal twisting thereof, the dislodged ice cubes then falling into the ice cube storage bin 18 (see FIGS. 1 and 2).

In accordance with one aspect of the present invention, a movable ice level sensing member in the preferred form of a one piece molded plastic sensing arm or bail 60 (see FIGS. 3, 4 and 9) is provided at a position underneath or below the ice tray 50. The bail 60 can extend downwardly and swing into the open top of the ice storage bin 18 (see FIGS. 1 and 2) so as to rest on top of the ice cubes stored therein. Like the ice tray 50, the bail is pivotally mounted between the front wall 21 and the front face 26 of the rear wall 25 (see FIG. 4) so that it can pivot or oscillate between a lowermost position indicative of a low level of ice cubes in the ice storage bin 18, and a raised higher level indicative of a maximum level of stored ice cubes. The bail 60 moves or pivots about a horizontal axis A—A as illustrated in FIG. 4. The bail 60 includes a front end portion 61 lying on axis A—A and a rear end portion 62 also lying on axis A—A. Radially spaced from the axis A—A is an arcuate intermediate ice level sensing portion 64, this intermediate portion engaging the upper level of the ice cubes stored within the ice storage bin 18 discussed earlier. The rear end portion 62 of the bail engages a rotatable bail drive member 62*a* journaled for rotary movement by a portion of face 26, the bail drive member 62*a* forming a portion of an arcuate cam track member 68 to be subsequently discussed in greater detail. The bail drive member 62*a* rotates to temporarily raise the bail 60 to an uppermost position so that it will not interfere with ice cubes falling from the tray 50 during an ice dumping operation. The rotatable bail drive member 62*a* then allows the bail 60 to return to a normal lower position, wherein it rests on the upper level of stored ice cubes after the associated ice dumping operation has been completed.

Figure 5:
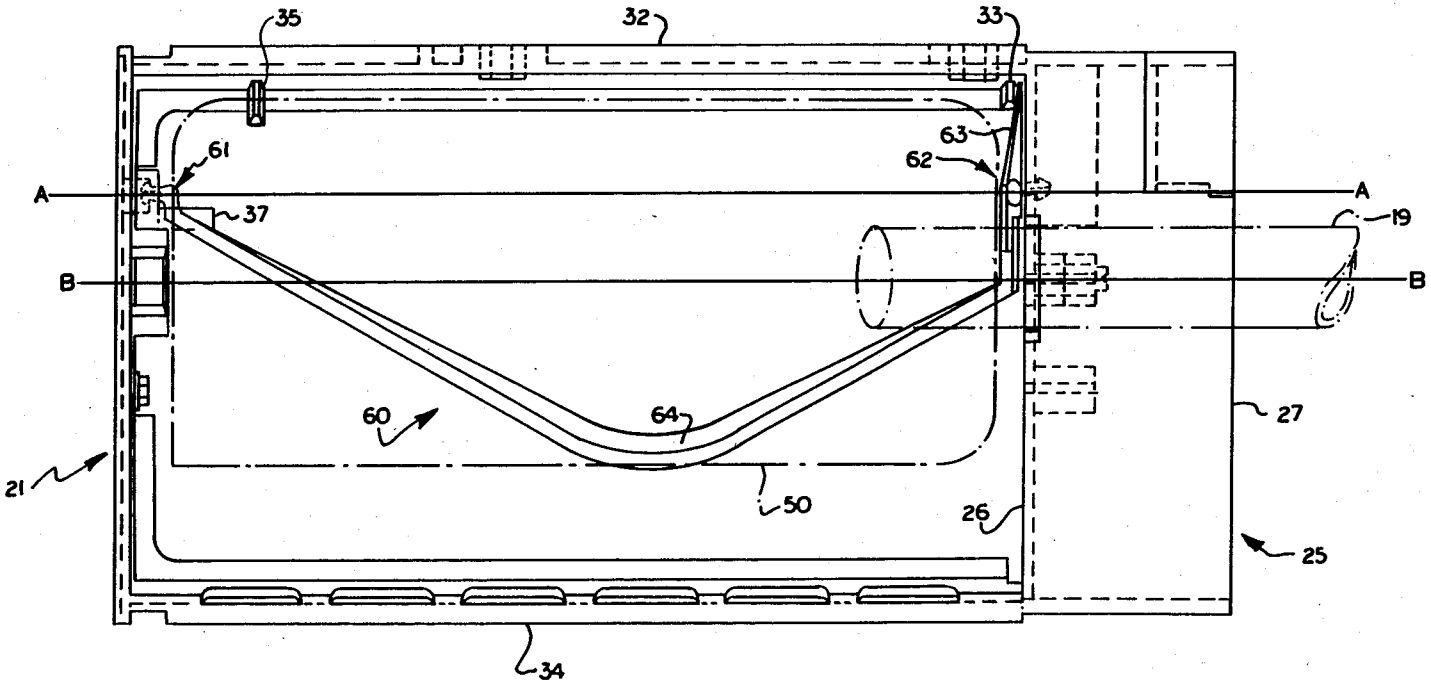
FIG. 5 is a top plan view of the ice maker with the ice tray shown in phantom.

With particular reference to FIGS. 3 and 5, wherein the ice tray 50 has been removed in a manner to be subsequently illustrated and discussed, the ice maker 20 can be seen to include, as a part of the left side wall 32, a first ice tray rotation stop 35 that limits the rotation of the ice tray in the counterclockwise direction as viewed from the front end of the ice maker. The left sidewall 32 also provides a channel forming member comprised of a vertically extending flange 33 that defines between it, and the adjacent portion of the front face 26 of the rear wall 25, a vertically extending channel area which receives the distal end of a fingerlike resilient projection 63 of predetermined length, generally radially extending from the rear end portion 62 of the bail 60 as illustrated. The projection 63, constituting an integral part of the molded plastic bail 60, functions as a springlike biasing means tending to move an intermediate portion 64 of the bail 60 towards a lowermost position. It can be seen that as the bail 60 moves upwardly in a counterclockwise fashion, as viewed from the front of the ice maker 20, the distal end of the resilient projection 63, having a length greater than the distance between axis A—A and the closest adjacent point of sidewall 32, will slidingly engage the channel formed between the flange 33 and rear wall face 26. The projection 63 moves downwardly in the channel to a limited extent causing increased flexure of the resilient projection 63 so as to apply an increasing biasing force tending to move the bail 60 downwardly. This biasing force insures that the intermediate portion 64 of the bail, when free to move downwardly, will be driven by the biasing force of the flexed projection 63 to solidly contact the upper level of ice cubes in the ice storage bin 18 as discussed earlier. As shown most clearly in FIGS. 4 and 5, the resilient fingerlike projection 63 is angled slightly toward the front face 26 of the rear wall 25 of the ice maker 20 to insure that its distal end will be slidably retained in the channel formed between the flange 33 and front face 26 as the bail 60 moves up and down.

The ice maker 20 is fixed in position at the upper end of the freezer compartment 13 (see FIG. 1) by means of a plurality of inverted key hole shaped apertures 32*a* (see FIG. 3) in the left sidewall 32 of the ice maker housing, the apertures receiving a like plurality of screws 32*b* that are threaded into apertures in the left sidewall of the freezer compartment 13 (see FIG. 1). As shown in FIG. 4, the circular lower portions of the keyhole apertures 32*a* have a diameter slightly greater than the heads of the screws 32*b* so as to permit, when the screws are in a loosened condition, raising of the ice maker 20 to align the screw heads 32*b* with the circular lower portions of the apertures 32*a* wherein the screw heads can fit through such lower aperture portions so that the ice maker 20 can then be removed from the freezer compartment for servicing if necessary.

With further reference to FIG. 4, the ice maker, shown in its mounted position, has its rear wall 25 located adjacent to an air conveying duct 15 which directs low temperature air across the top of the ice tray 50 to cause freezing of water contained therein. The duct 15 is mounted to the rear wall portion 17 of the freezer compartment as illustrated. As noted earlier, the fill tube 19 extends through the rear wall portion 17 and has its outer end or nipple portion 19*b* connected to a source of water controlled by a conventional normally closed, solenoid valve (not shown) which, when actuated to an open condition, allows a controlled amount of water to flow from the distal end of the fill tube 19 into the ice tray 50.

Extending from the front face 26 of the rear wall 25 is a drive end of a hollow drive shaft 40 for moving and rotating the ice tray 50 between its upright ice making position and its inverted ice dumping position. The drive shaft 40 is preferably formed of suitable plastic material as are most of the other ice maker components. The drive shaft 40 is journalled for rotary movement by a portion of the front face 26 of the rear wall 25 as illustrated. Extending through the hollow center of the rotatable drive shaft outer end is a flexible thermister tipped temperature probe 42. The drive shaft 40 will, during an ice dumping operation, rotate to a slight degree counter clockwise from its position illustrated in FIG. 3 to cause an initial ice cube dislodging flexure of the ice tray, and then rotate to a greater degree clockwise to effect further flexure of the tray and dumping of ice cubes therefrom. Upon completing the ice dumping operation, the drive shaft 40 will reverse its direction of rotation and then return by counterclockwise rotation to its normal position illustrated in FIG. 3.

With particular reference to FIG. 4, the ice tray 50 includes a cylindrical projection 52 at the central portion its front end, this projection 52 being integrally formed with and as a portion of the plastic tray 50. The ice tray 50 also includes an integrally formed, centrally located, driven end portion 54 at its rear end, the projection 52 and the driven end portion 54 lying along the axis of rotation of the ice tray 50. As will be subsequently illustrated in greater detail, the driven end portion 54 of the ice tray 50 is in the shape of a rectangular socket that receives and engages the rectangularly extending outer end of the drive shaft 40 (see FIG. 3). The cylindrical projection 52 at the front end of the tray 50 is rotatably supported by and rests upon a U-shaped flange 24 (see FIG. 4) extending horizontally from the inner side or face 22 of the front wall 21, the flange 24 to be subsequently illustrated in greater detail.

As shown most clearly in FIG. 5, it can be seen that the bail 60 can move in oscillatory fashion on axis A—A, while the ice tray 50 can in a similar manner move in oscillatory fashion on its horizontal axis of rotation B—B, which is parallel to and spaced from axis A—A, the axis A—A lying below and to one side of the axis B—B. In FIG. 5, it can also be seen how stop 35 interferes with counterclockwise rotation of ice tray 50 (illustrated in phantom) by engaging one of its front corner lips.

Referring to FIG. 4, when the ice tray 50 is at its mounted position, its rear end receives the temperature probe 42 which is thermally insulated by a cuplike foam block 43 fixed to the underside of the ice tray 50 as illustrated, the probe sensing the temperature associated with a centrally located one of the ice cube pockets 51 of the tray 50.

In general, the operation of the ice maker 20, illustrated in FIGS. 1 through 5 is as follows. A controlled amount of water provided by the fill tube 19 falls into the empty pockets 51 of the ice tray 50. Cold air from duct 15 blows across the top of the ice tray where, after a predetermined period of time, the water in the pockets 51 freezes into ice cubes as sensed by the temperature probe 42. With the bail 60 at a lowered condition as illustrated in FIG. 4, the tray 50, as viewed from the front of the ice maker, will rotate to a slight degree counterclockwise wherein the associated front corner lip or edge of the tray will engage the top of ice tray stop 35 to cause flexure of the tray along its longitudinal extent thereby dislodging the ice cubes contained therein at least to a limited degree. The tray 50 will then rotate counterclockwise until it engages another ice tray stop (to be subsequently illustrated) to cause additional flexure of the tray in a reverse direction from that caused by stop 35 wherein, with the ice tray 50 in a nearly inverted condition, ice cubes will fall from the ice tray into the bin 18. When the ice cubes have fallen from the tray 50, it will rotate counterclockwise to return to its normal ice making position as illustrated in FIG. 4. As noted earlier, during the inverting of the ice tray 50 and the dropping of the ice cubes therefrom the ice level sensing bail 60 is raised by the drive mechanism of the ice maker so as not to interfere with the falling ice cubes. When an ice dumping operation has been completed, the bail is allowed, under the force of the spring-like biasing means constituted by the resilient projection 63, to return to a lowered position wherein its intermediate portion 64 rests upon the now raised level of ice cubes contained in the storage bin 18. The reading of the temperature probe 42 and the position of the bail 64 determines when an ice dumping operation of the ice maker 20 can occur.

Figure 6:
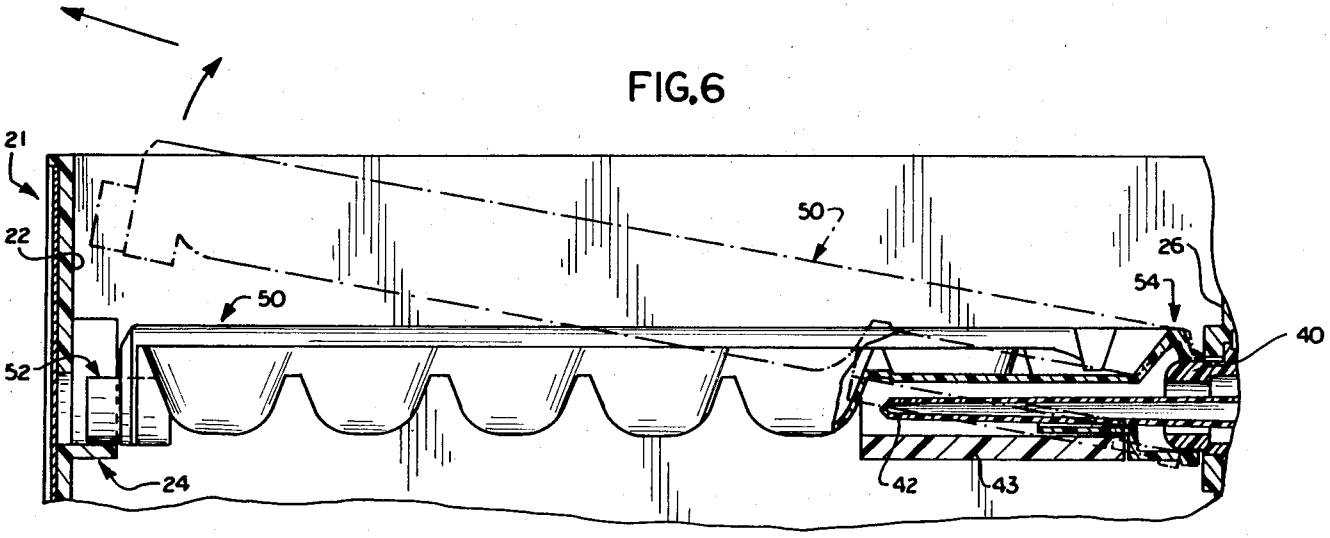
FIG. 6 is a side view of the removable ice tray of the ice maker, and its associated pivotal mounting means.
Figure 8:
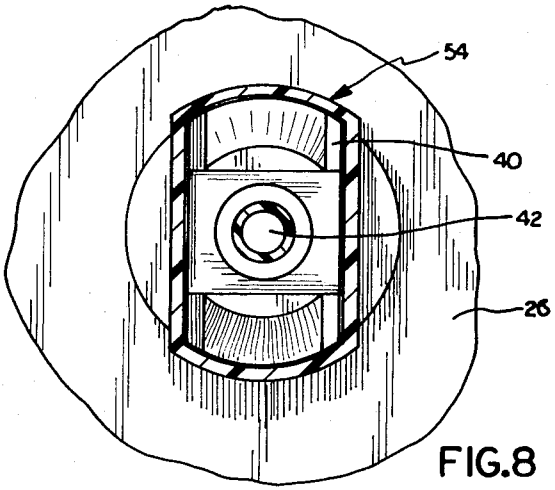
FIG. 8 is an end view of the rear end of the ice tray at its normal pivotally mounted position relative to its associated mounting means.
Figure 7:
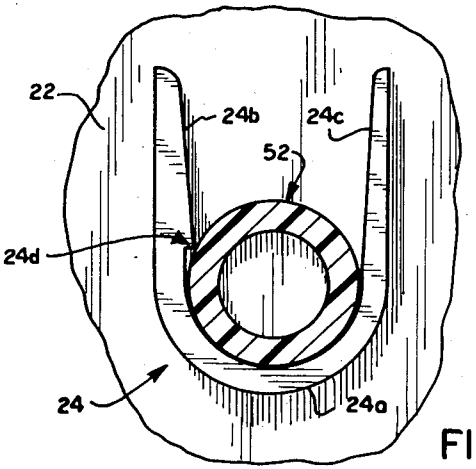
FIG. 7 is an end view of the front end of the ice tray at its normal pivotally mounted position relative to its associated mounting means.

In accordance with another aspect of the present invention, the ice tray 50 can easily be removed to permit thorough cleaning of the ice tray at a location outside of the freezer compartment. With particular reference to FIGS. 6, 7 and 8, the ice tray 50 can be raised upwardly at its front end as illustrated in phantom wherein the cylindrical projection 52 moves out of engagement with the U-shaped support flange 24. When the front of the ice tray 50 clears the upward end of the front wall 21, its rear end can easily be pulled off of the outer end of the drive shaft 40, it being again noted that the temperature probe 44 is flexible to permit such upward movement of the ice tray 50.

FIG. 7 most clearly illustrates the U-shaped support flange 24 as including an arcuate shelflike base portion **24*a* having a radius of curvature generally equal to that of the outer surface of the cylindrical projection 52, and a pair of vertically extending upright parallel legs 24*b*, 24*c* spaced from each other to a degree slightly greater than the diameter of the supported cylindrical projection 52. The upwardly extending leg 24*b* includes a toothlike projection constituting a detent or retaining means 24*d* which interferes with movement of the projection 52 of the ice tray onto and off of the shelflike base portion 24*a* of the U-shaped flange 24. It will be recognized that the cylindrical projection 52 is received into the upper area of the space defined between the legs 24*b* and 24*c*. The projection 52 is then pressed downwardly and snapped pass the retaining means 24*d* into position on the shelflike base portion 24*a* of the flange 24. It is to be noted that the retaining means 24*d* constituted by the toothlike projection from the leg 24*b* of the flange 24 is spaced a predetermined degree above the shelf portion 24*a* so as not to interfere with free rotation of the cylindrical projection 52 when it is resting upon the base portion 24*a***.

With particular reference to FIG. 8, it can be seen that the outer end of the hollow drive shaft 40 for rotatably driving the ice tray 50 is generally rectangular in shape and has projecting from its center, through an aperture therein, the thermister tipped flexible temperature probe 42. The generally rectangular outer end of the drive shaft 40 is received into a generally rectangular socket constituted by the driven end 54 located at the rear end of the ice tray 50. The socketlike driven end 54 slides onto and off of the rectangular outer end of the drive shaft 40 to facilitate easy removal and reinstallation of the ice tray 50 as best illustrated by FIG. 6.

Figure 9:
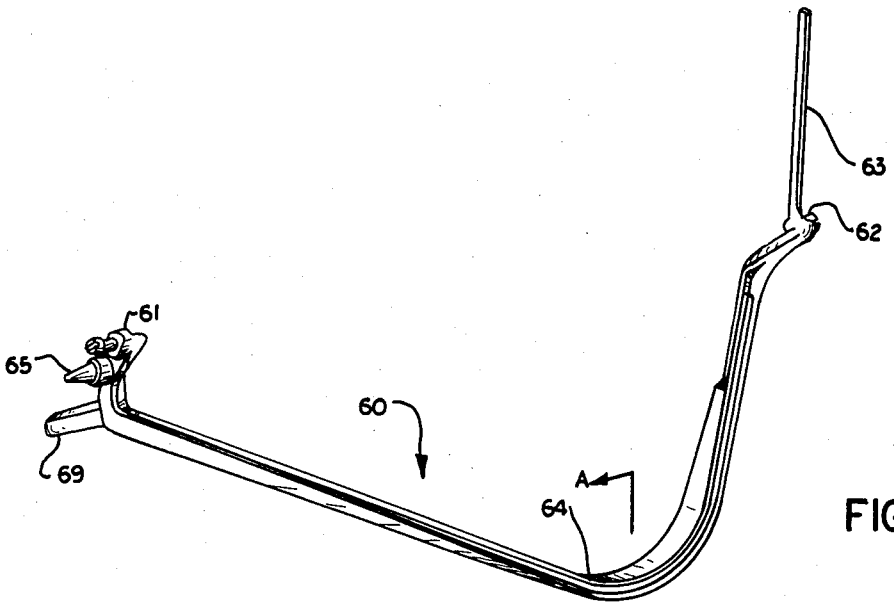
FIG. 9 is a perspective view of the ice level sensing bail member of the ice maker.

Turning to FIGS. 9 and **9*a*, it can be seen that the one piece, molded plastic bail 60 is of variable cross-sectional area along its length. To provide needed strength, the curved intermediate portion 64 of the elongated bail has a cross sectional area greater than the remaining portions thereof. The cross-sectional area of the bail generally gradually decreases along its extent from the intermediate portion 64 toward both of the end portions 61, 62 of the bail. As shown most clearly in FIG. 9***a*, the cross-sectional area of the bail 60, at least along the extent of its curved intermediate portion 64, is in the general shape of a flattened oval, having opposed, parallel flat surfaces 64*a*, 64*b* that extend generally vertically when the bail is at an uppermost raised position. Thus, as the bail moves downwardly, the relatively large flat face 64*b* along the lower part of its intermediate portion will engage more of the upper ice surface of the accumulated ice cubes so that the bail will not move down into the ice cubes to a point below their upper level which is being monitored.

Figure 10:
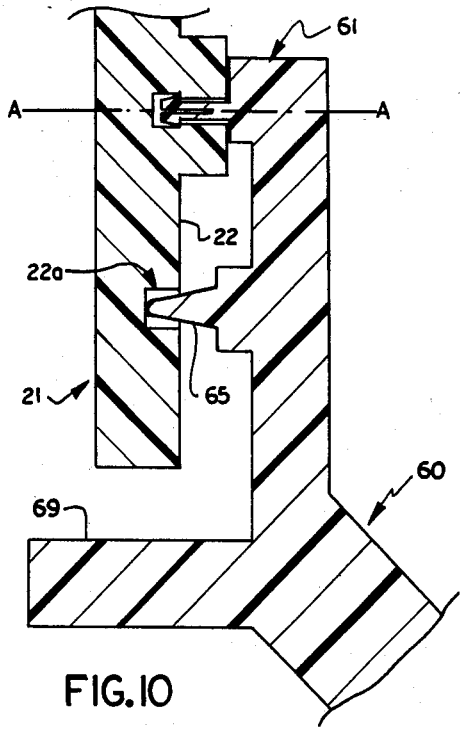
FIG. 10 is a side view of a detent providing end portion of the ice level sensing bail member of the ice maker.
Figure 11:
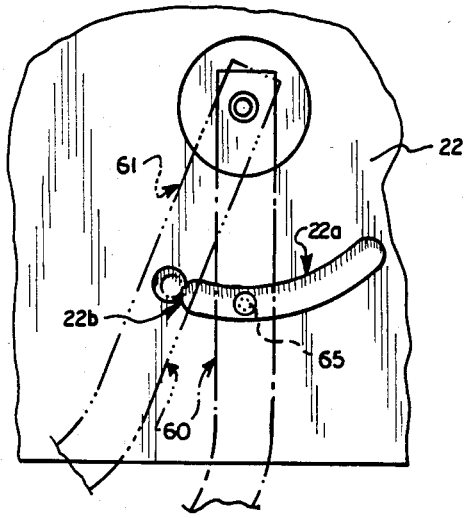
FIG. 11 is an end view of the portion of the bail illustrated in FIG. 10.
Figure 9A:
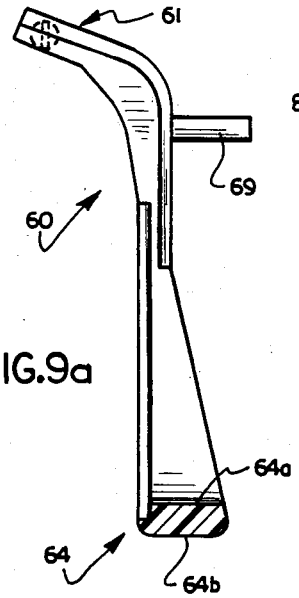
FIG. 9*a* is a view along line A—A of FIG. 9 of the ice level sensing bail member of the ice maker.

Turning to FIGS. 10 and 11, a locking mechanism for retaining the bail 60 at its raised position is illustrated. Such a mechanism can be used for example to preclude an ice dumping operation by the ice maker when the underlying ice storage bin has been removed from the freezer compartment for cleaning. In accordance with the present invention, the plastic bail 60 includes, as an integral portion thereof, a projection 65 located generally at the front end of the bail and radially spaced from the horizontal axis A—A wherein the projection 65 moves along a curved path as the intermediate portion 64 of the bail swings between its uppermost and lowermost positions. The projection 65, preferably in the form of a cone having a base and a distal apex end, extends into and rides in a curved groove 22*a* of predetermined width, the groove corresponding in curvature to the curved path that the projection 65 follows as illustrated in FIG. 11. The groove 22*a* is provided in the inner face 22 of the front wall 21. When the bail 60 is raised to its maximum position (shown in phantom), the projection 65 engages and snaps through a detent or retaining means 22*b* and is held at the end of the groove by the detent means 22*b* until the user, using a handle projection 69, also integrally formed as a portion of the molded plastic bail 60, forceably releases the bail 60 from its locked position wherein the biasing force provided by the earlier discussed resilient projection 63 (and the normal force of gravity) swings the bail downwardly until it contacts the upper level of ice cubes in the underlying storage bin. The manually grippable handle 69 is used to both lock and unlock the bail, it being recognized as discussed earlier that when the bail is locked in its raised position the ice maker will not dump ice. Preferably, as best illustrated in FIG. 11, the detent means 22*b* is constitute by a reduced width portion of the groove 22*a* wherein free movement of the distal apex end of the conelike projection 65 is interfered with by the reduced width portion of the groove 22*a* so as to generally retain the distal end of the projection 65 at the detent end of the groove 22*a*.

It can be seen that the one piece, molded plastic bail 60 provides not only an ice level sensing function but also incorporates its own springlike biasing means in the form of a fingerlike projection 63 discussed earlier with regard to FIGS. 3, 4 and 5, and also provides a locking mechanism for temporarily holding the bail in its raised position as illustrated and discussed with regard to FIGS. 10 and 11.

Figure 12:
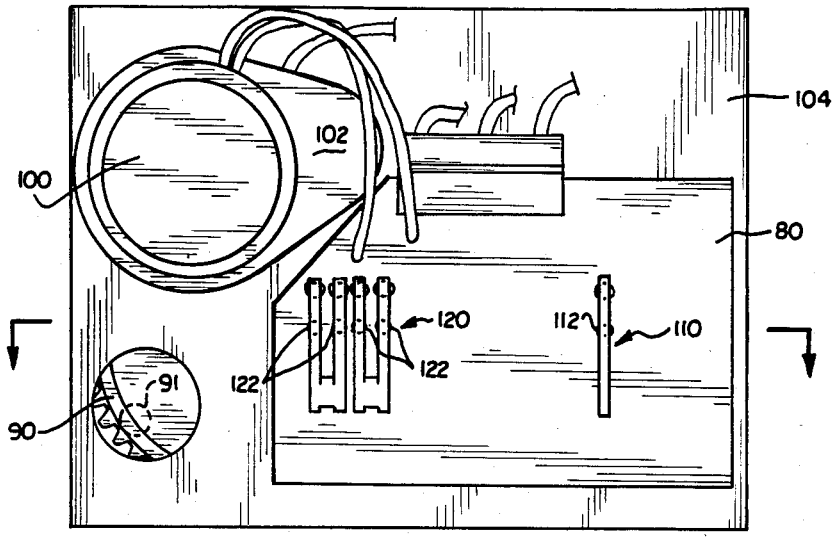
FIG. 12 is an elevation view, from the rear end of the ice maker, of the control circuit board and drive means that is mounted within the hollow rear wall of the ice maker housing.
Figure 12A:
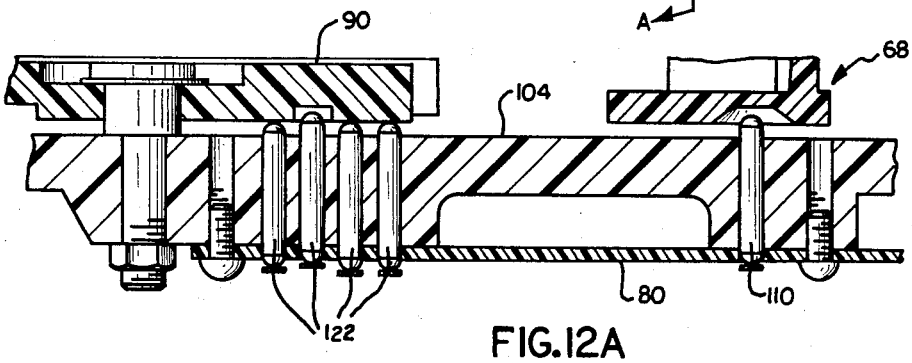
FIG. 12A is a cross-section view taken along line A—A of FIG. 12.

Turning to FIGS. 12 and 12A, there is illustrated a portion of a mechanism for concurrently moving the ice tray and the bail as discussed earlier. This mechanism takes the form of an electrically energized drive means consituted by a motor 100 which rotates a pinion type drive gear (not shown) via a conventional reducing gear transmission 102. The motor 100 and its transmission 102 are mounted on one side of a support substrate 104, the drive pinion being located on the other side thereof for engagement with the toothed periphery of a relatively large diameter drive gear 90. The drive gear 90 includes circular cam tracks of varying radius centered on the axis of rotation of gear 90, the cam tracks engaging with the ends of the cam follower type pins 122 that slidably extend through the support substrate 104 to sequentially actuate with their other ends a plurality of control switches 120 mounted on a printed circuit board 80. The board 80 carries a plurality of electronic components comprising the electronic control circuit for the ice maker 20. In addition to the plurality of control switches 120, the circuit board 80 also supports an ice level sensing switch 110 which is actuated by the movement of the earlier discussed bail 60 via a cam follower pin 112 (also slidably mounted in an aperture through elements 80 and 104) in a manner to be subsequently illustrated. The support substrate 104 carrying the noted components is received into the hollow rear wall 25 (see FIG. 3) and mounted in parallel relation to the inside surface of the front face 26, with the drive gear 90 being sandwiched between the substrate 104 and the inner surface of the front face 26 of the ice maker 20.

Figure 13A:
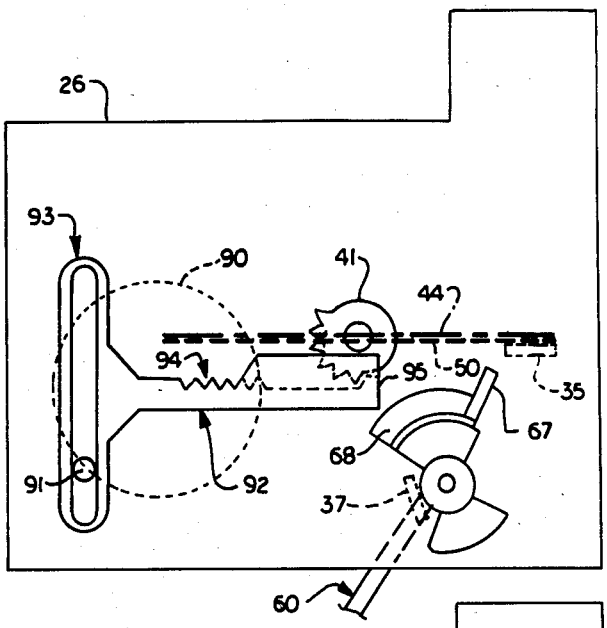
FIGS. 13A, 13B and 13C sequentially illustrate in schematic fashion the cycle of operation of the drive means for moving the ice tray between an upright ice making position and an inverted ice dumping position, and for moving concurrently with the ice tray the associated ice level sensing bail.
Figure 13B:
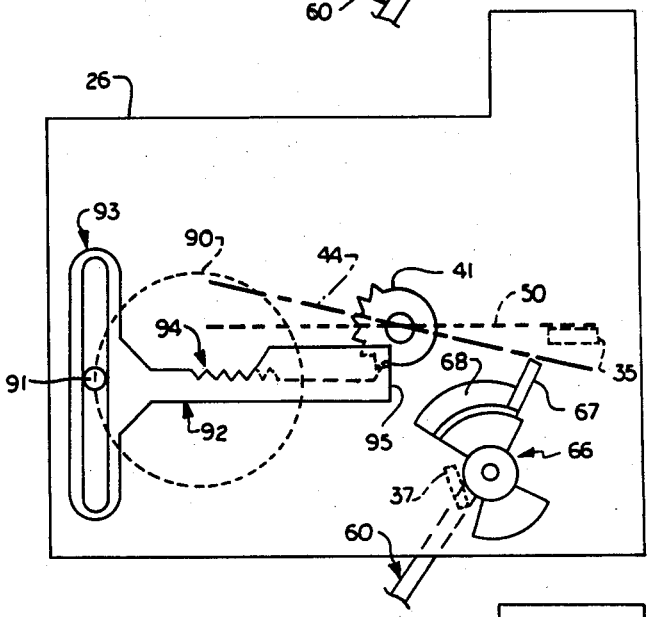
Figure 13C:
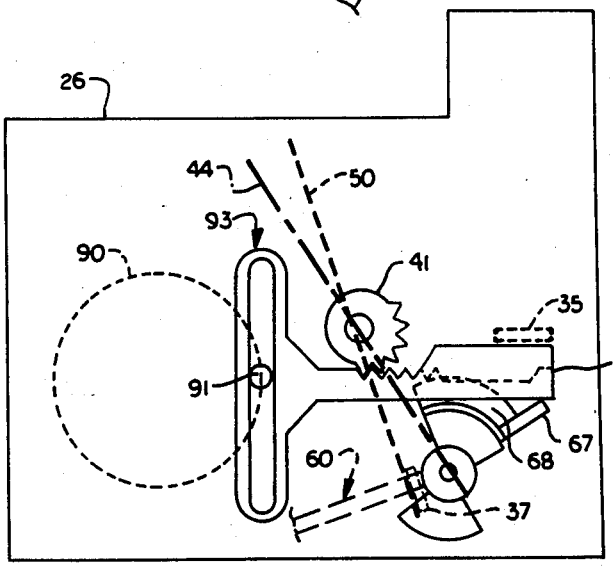

A clearer understanding of the operation of the ice maker in accordance with the present invention can be had by reference to the schematic drawings of FIGS. 13A–13C. As discussed earlier with regard to FIG. 12, the relatively large diameter drive gear 90 driven by the electric motor 100 includes a crank pin 91 for driving a rack bar 92 slidably mounted on the interior or inside surface of the front face 26. The rack bar includes a plurality of rack bar teeth 94 that can engage with the teeth of an interrupted ice tray drive pinion 41 constituting the inner end of the hollow rotatable drive shaft 40 having its outer end rotatably engaged with the ice tray 50 as discussed earlier with regard to FIGS. 3 and 4. Also located adjacent the interior surface of the front face 26 is an arcuate cam track member 68 having a radial finger 67 engageable with an end 95 of the rack bar 92. The arcuate cam track member 68 rotates or oscillates on the axis of rotation (see axis A—A of FIG. 4) provided by its rotatable bail drive portion 62*a* discussed earlier with regard to FIGS. 3 and 4. The arcuate cam track member 68 has an arcuate cam track that is engageable with one end of the cam follower pin 112 that actuates the ice level sensing switch 110 (as illustrated in FIG. 12) as the bail 60 moves between a lowermost and uppermost position.

With particular reference to FIG. 13A, the crank pin 91 is received into a yoke loop 93 of the rack bar 92. In FIG. 13A, the front end of the ice tray 50 is illustrated schematically in its horizontal starting position, while a designated starting horizontal plane of rotation 44 of the pinion 41 is also shown in a horizontal position. As the gear 90 rotates in a clockwise manner, pin 91 will move the rack bar 92 leftwardly to a slight degree as shown in FIG. 13B. The end 95 of the rack bar 92 engages a tooth of the interrupted pinion 41 to cause limited clockwise rotation of the pinion 41 as illustrated. However, ice tray stop 35 (discussed and illustrated earlier with regard to FIGS. 3 and 5) precludes rotation of the front end of the ice tray 50 wherein the flexible ice tray twists and flexes along its extent so as to loosen ice cubes contained therein. It should be noted that with regard to both FIGS. 13A and 13B, the bail 60 is biased by fingerlike projection 63 (see FIG. 3) towards its lowermost position and resting on the level of ice cubes in the underlying storage bin. With reference to FIG. 13C, the crank pin 91 continues to move in a clockwise manner so as to push the rack bar 92 rightwardly wherein its teeth 94 engage the teeth of the pinion 41 and rotate it in a counterclockwise manner to a nearly inverted ice dumping position. It can be seen that the pinion rotates the rearward end of the tray 50 past the position of a second ice tray stop 37 (see also FIGS. 3 and 5) extending from the inside face 22 of the front wall 21, the second stop 37 precluding rotation of the front end of the ice tray wherein flexure of the ice tray again occurs, but in the reverse direction as that caused by the first ice stop 35, so as to further dislodge ice cubes from the ice tray wherein they fall into the underlying ice storage bin.

With further reference to FIG. 13C it can also be seen that the end of the rack bar 95 has engaged the radial finger 67 of the arcuate cam track member 68 which includes the rotatable drive portion 62A illustrated and discussed earlier with regard to FIG. 4. In so doing, the bail 60 is raised as illustrated in FIG. 13C so as not to interfere with the falling ice cubes. At this position, the cam track or the cam member 68 has also moved pin 112 toward ice level switch 110 so as to actuate it (see FIG. 12). It will be recognized that the crank pin 91 will continue moving in a clockwise manner until it returns to its starting position illustrated in FIG. 13A wherein the ice tray has been returned to its normal horizontal ice making position and the bail has been allowed to return to its ice sensing position i.e. the intermediate portion 64 (see FIGS. 3 and 4) is now resting upon the raised upper level of ice cubes contained in the storage bin. If the level of ice in the underlying storage bin has been sufficiently raised, the bail will hold, via cam member 68, the switch 110 in an actuated condition to preclude further ice cube dumping as will be subsequently discussed.

During such ice harvesting operation, the cam tracks carried on one side of the drive gear 90 sequentially move the four switch actuating cam follower pins 122 that, in turn, sequentially actuate the switches 120 as discussed earlier with regard to FIGS. 12 and 12A. These control switches 120 regulate the sequence of operation of the ice maker as will be subsequently discussed with regard to FIGS. 15 and 16.

Figure 14:
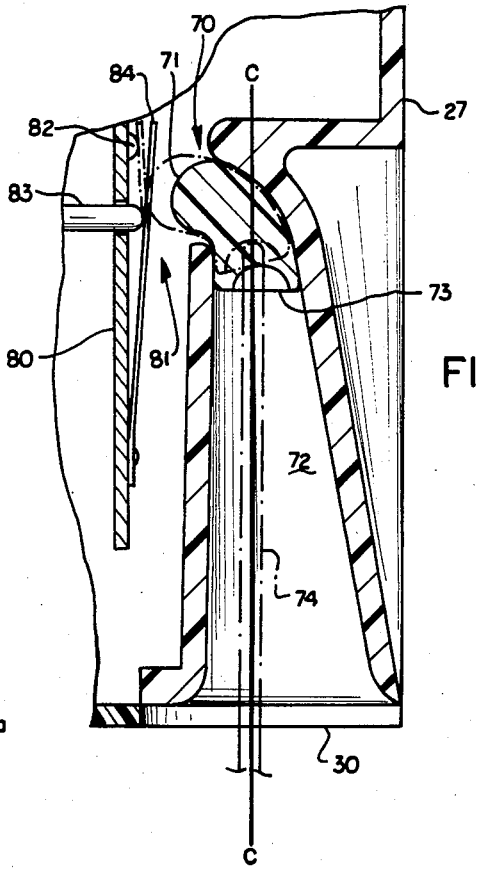
FIG. 14 illustrates a novel mechanism for actuating a test switch enclosed in the hollow rear wall of the ice maker housing.
Figure 14A:
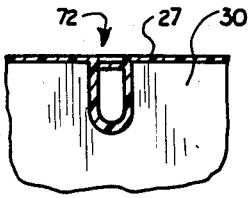
FIG. 14*a* is a bottom view of FIG. 14.

With particular reference to FIGS. 12, 14 and **14*a*, one of the switches 120 (designated as switch 81) also functions as a test switch to allow initiation of an ice harvesting or dumping operation. The switch means 81, is normally closed and includes a fixed contact 82 located on the circuit board 80 and a resilient movable contact 84 (also mounted on circuit board 80) that can be engaged and disengaged from the fixed contact 82. One of earlier mentioned slidably mounted cam follower pins 122, designated in FIG. 14 as element 83, extends through an aperture in the circuit board 80 to move the contact 84 into and out of engagement with the contact 82. As will be subsequently illustrated, with the ice maker in its normal ice making condition, (horizontal ice tray) wherein the cam pin 83 is holding the normally closed switch 81 in an open condition, such open condition can be overridden to initiate an ice dumping operation by means of an externally actuated mechanism illustrated in FIG. 14. The mechanism includes a kidney shaped button member 70 formed of electrical insulation material, e.g. plastic, the button member having an inner end 71 engageable with the top end of movable contact 84, and an outer end 73 being recessed as illustrated. In a preferred form, the button member 70 is slidably mounted and loosely retained in an aperture located at the bottom of a recess 72 preferably provided in the bottom face 30 of the hollow rear wall 25 of the ice maker 20 (see also FIG. 14*a*). The recess is sized to preclude movement of the button member 70 by, for example the finger of a user. To depress the button member 70 a probelike tool 74 (illustrated in phantom) is inserted into the recess 72 as illustrated. The inner end of the tool being received in the recess end 73 of the button member 70. A pushing force along axis C—C is applied to the outer recessed end 73 of the kidney shaped button member 70, the button member, in response to this pushing force, slidably moving in a rockinglike manner from a first position to a second position (illustrated in phantom) wherein the inner end 71 of the button member moves radially away from the longitudinal axis C—C to engage and electrically close the test switch 81** (as illustrated in phantom), the test switch being located at a point radially spaced from the longitudinal axis C—C as illustrated.

Thus, normally closed switch 81, held in an open condition by cam follower pin 83, can nevertheless be closed momentarily by the illustrated movement of button member 70 as illustrated. When as ice harvesting cycle has been initiated, pin 83 will move away from the movable contact 84 wherein switch 81 can assume its normally closed condition until pin 83 again moves it and holds it at an open condition when an ice harvesting cycle has been completed.

When the pushing force applied by the tool 74 to the button member 70 is removed the resiliency of the contact member 84 acts as a biasing force and pushes back against the button member 70 to return it to its normal position. As will be subsequently illustrated, the button member 70 is held in its depressed position for a few seconds until the ice maker has begun an ice dumping operation wherein the button member can then be released, the ice maker continuing operation until it completes the ice dumping operation. It can thus be seen that an ice harvesting opeation can be easily initiated by service personnel for test purposes without having to remove the ice maker 20 from the freezer compartment since the bottom face 30 of the hollow rear wall 25 can be easily reached. Also, the button member 70 formed of electrical insulating material, provides electrical isolation between the switch 81 and the tool 74 held by the test personnel thus providing a safety feature precluding electrical shock.

Figure 15:
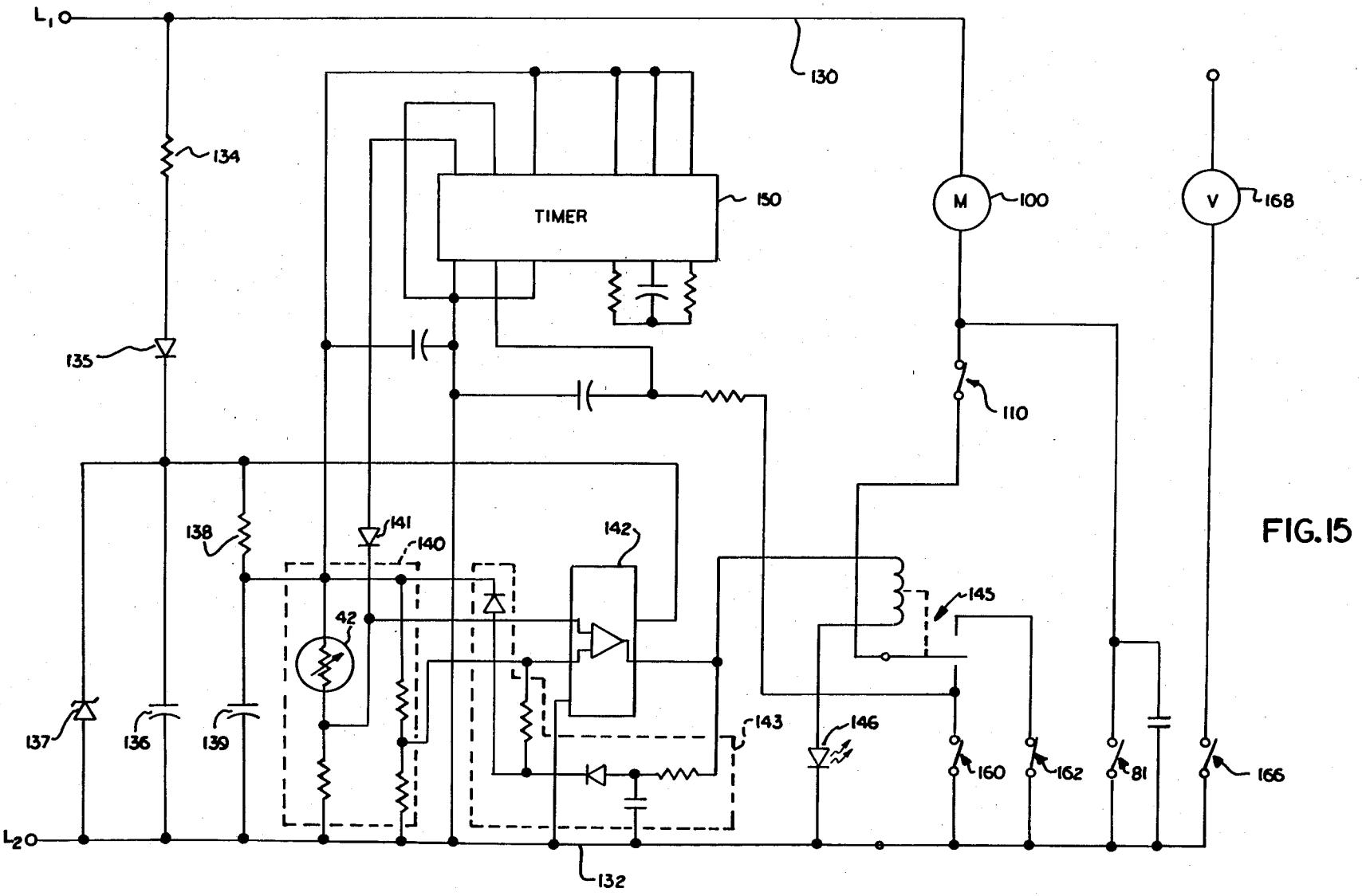
FIG. 15 is a schematic diagram of the ice maker electronic control circuit.

A further understanding of the operation of the electronic control circuit regulating the ice maker can be had by reference to FIG. 15. The control circuit is energized by a pair of input power terminals L1, L2 providing, for example, commerical power at 115 volt alternating current at 60 Hz. The power provided to terminals L1 and L2 is carried on a pair of power lines 130, 132 as illustrated. Connected in series relation between the lines 130, 132 are a conventional fill tube heater 34 of the resistance type, a half wave rectifier in the form of a diode 135, and a filter capacitor 136. As is well recognized in the art, direct current will flow through the fill tube heater 134 to preclude freezing of water in the distal end of the fill tube 19 discussed earlier. The diode 135 functions as a half rectifier to provide direct current to the filter capacitor 136 which smooths the pulsating DC voltage provided by the diode 135. A voltage regulating Zener diode 137 connected in parallel across the capacitor 136 provides a regulated, low voltage DC supply of, for example, 27 volts across capacitor 136.

The regulated 27 volt DC power is provided to an integrated circuit operational amplifier 142 having an output which energizes the coil of a relay 145 via a light emitting diode 146.

The earlier discussed thermister tipped temperature probe 42 is schematically illustrated as forming a portion of multi-resistor, four-legged, symmetrical bridge circuit 140 whose output is provided to the integrated circuit operational amplifier 142 configured as switching means by use of a conventional multicomponent positive feedback circuit 143. A voltage dividing resistor 138, and associated filter capacitor 139, provide a further reduced DC voltage (approx. 12 VDC) to the bridge circuit 140 as illustrated and also to a conventional integrated circuit timer 150 to be subsequently discussed. Temperature measurements made by the bridge circuit 140 using thermister probe 42 are supplied to the switch configured amplifier 142 whose output controls (via relay 145) application of 115 volt AC power to a solenoid actuated water valve 168 for providing water to the fill tube 19 discussed earlier, and to the motor 100 that rotates the earlier discussed drive gear 90 carrying cam tracks that in turn actuate in a predetermined sequence of operation switches 120 (see FIG. 12) the switches being comprised of a reset switch 160, a delay switch 162, the test and hold switch 81 (i.e., switch 81 also functions as a test switch as discussed earlier with regard to FIG. 14) and a solenoid actuating fill switch 166. The ice level sensing switch 110, when in an open condition (ice bail 60 as discussed earlier is at a maximum raised position), will preclude normal operation of the motor 100. An integrated circuit timer 150 establishes a predetermined period of time for allowing the ice cubes to form in the ice pockets of the ice tray and can also delay an ice dumping operation under certain condition. A blocking diode 141 allows the timer 150 to in effect short out thermister 42 to delay an ice harvesting cycle.

The operation of the circuit components thus far illustrated and discussed is known in the art as evidenced by earlier noted U.S. Pat. No. 4,142,373 owned by the assignee of the present invention. Specific details as to the operaton of the circuit can be obtained from a review of such prior art patent. The only significant difference between the prior art control circuit and the illustrated control circuit of FIG. 15 is in the use of a timer 150 which does not have the accuracy of the timer component IC2 of the noted prior art patent, it being determined that the cost of providing such timer accuracy was not warranted or necessary for acceptable operation of the ice maker control circuit.

Figure 16:
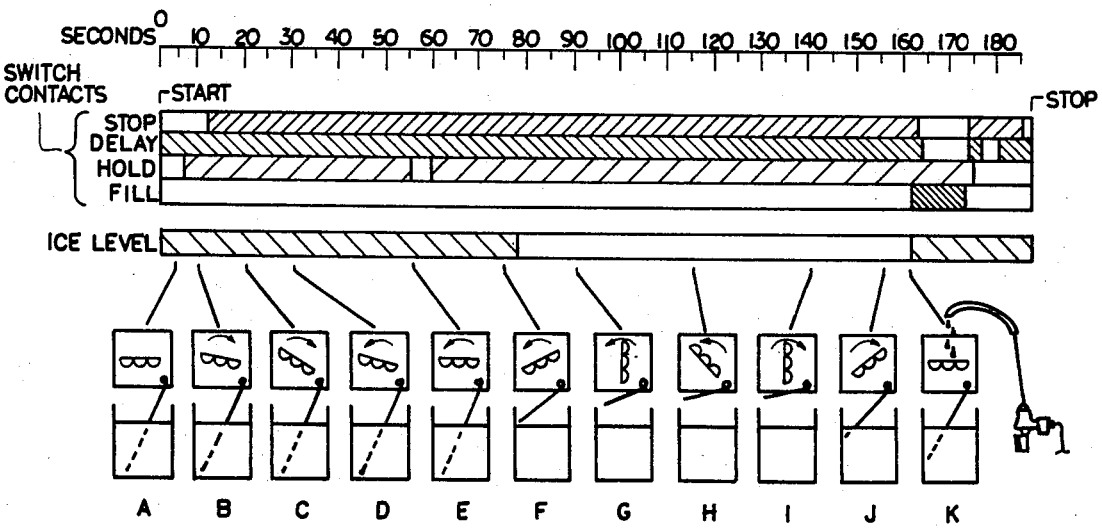
FIG. 16 is a control sequence chart illustrating the cycle of operation of the ice maker.

With reference to the control sequence chart of FIG. 16 (read left to right), an ice dumping cycle of operation will now be discussed. As illustrated in FIG. 16, the relative positions (opened or closed) of the stop, delay, hold, fill and ice level sensing switches discussed earlier can be seen. Also, the corresponding positions of the ice tray 50 and the bail 60 during the course of an ice harvesting or dumping cycle are schematically illustrated. With reference to the top time line of the chart of FIG. 16, it can be seen that an ice harvesting cycle takes approximately three minutes (185 seconds). At the beginning of a harvesting cycle, the stop switch is in an open condition, the delay switch is in a closed condition, the hold and fill switches are in an open condition, and the ice level sensing switch is in a closed condition which indicates that the level of ice in the underlying storage bin is low enough to permit the addition of more ice to the bin. It can be recognized that if the ice level switch was in an open condition, i.e. if the bail was raised high enough either by ice in the bin or manually by the user that an ice harvesting cycle could not be initiated since ice level switch 110 would preclude energization of the motor, the hold switch 164 being in an open condition as illustrated. Assuming that the control circuitry regulating relay 145 initiates an ice harvesting cycle, power will be provided to the motor via delay switch 162 (see FIG. 15) wherein the motor will begin to rotate earlier discussed gear 90 which carries on it the cam tracks for providing the sequential switching as illustrated in FIG. 16. With the motor 100 rotating, it can be seen that after approximately five seconds, the hold switch is actuated to a closed condition. After about twelve seconds, the stop switch is actuated to a closed condition and the ice tray 50 has begun rotating in a first direction until it contacts its first stop and flexes the dislodged ice cubes as discussed earlier. As the ice harvesting cycle continues, the direction of rotation of the ice tray 50 reverses, and the tray 50 moves to a nearly inverted condition. In moving towards the inverted condition, it can be seen that at about 80 seconds into the ice harvesting cycle the ice level switch opens to a nonconducting condition since the bail 60 has been raised out of the way in anticipation of ice cubes falling from the nearly inverted tray 50. During this time, the stop, delay and hold switches are all closed as illustrated thus sustaining power flow to the motor 100 (see FIG. 15). At about the 163 second point in the ice harvesting cycle, it can be seen that the stop and delay switches move momentarily to an open condition while the hold switch remains closed so as to continue to supply power to the motor 100. It can also be seen that at this time the bail 60 is returned to its lower position and recloses the ice level sensing switch. At this 163 second point in the harvesting cycle, the now empty ice tray 160 has returned to its normal upright, horizontal condition and fill switch 166 has closed so as to energize solenoid valve 168 wherein water is provided to the tray 50 as illustrated. At approximately 175 seconds the fill switch is reopened by the respective cam surface on gear 90 to preclude water flow to the ice tray. By the end of the harvesting cycle, the open condition of the hold, fill and stop switches is re-established with only the delay switch being in a closed condition at the start of another ice harvesting cycle. It should be noted that if the ice level switch remained in an opened condition due to a high level of ice in the storage bin an ice harvesting cycle could not be initiated until the level of ice in the bin is lowered. It can also be seen that at approximately the 55 second point the hold switch momentarily opens, and that at the 176 second point the delay switch momentarily opens. The noted hold switch opening stops the harvest cycle if the storage bin is removed, i.e., the bail is raised to its locked position and the ice level switch is open. The noted delay switch opening caused a delay before the next ice harvesting cycle due to a thermister temperature reading a potentially faulty ice dumping operation, i.e., a stuck ice cube in the pocket whose temperature is being measured by the thermister.

Finally, it can be seen that an ice harvesting cycle can be initiated without waiting for a harvest cycle signal from the electronic control circuitry by simply manually closing the hold switch 81 by use of the earlier discussed test button 70, the switch being maintained in a closed condition for about five or six seconds until the hold switch is maintained in a closed condition by its associated cam track on the rotating drive gear 90 wherein the ie harvest cycle will continue for observation by service personnel.

Additional information as to the cycle of operation of the ice maker can be had by reference to the discussion of FIG. 22 of earlier noted U.S. Pat. No. 4,142,373.

It can be seen that an automatic ice maker 20 of simpler construction than those of the prior have been provided.

Although the preferred embodiment of this invention has been shown and described, it should be understood that various modifications and rearrangements of the parts may be resorted to without departing from the scope of the invention as disclosed and claimed herein.

What is claimed is:

1. An automatic ice cube maker for use in the freezer compartment of a domestic refrigerator comprising:

a housing having a generally open top and bottom defined by a front wall, a rear wall, and a pair of opposed sidewalls;

a compartmented ice tray having a top side constituted by a plurality of ice cube shaped pockets for receiving water to be frozen, the ice tray being horizontally mounted within the walls of the housing for movement between an upright ice making position and an inverted ice dumping position;

an electrically energized drive means connected to the ice tray for moving the ice tray between its upright and inverted positions;

a control circuit for energizing the drive means; and a movable ice level sensing member located below the ice tray and pivotally mounted to the housing for oscillatory movement on a horizontal axis, the sensing member being engageable with the upper level of temporarily stored ice cubes accumulating at a generally fixed location below the ice maker, a portion of the sensing member moving towards and away from the ice tray as the raising and lowering of the level of stored ice cubes occurs, the sensing member actuating a switch means of the control circuit when the sensing member portion moves towards the ice tray to a predetermined position indicative of a maximum raised ice level wherein movement of the ice tray to its dumping position is inhibited by the control circuit until the sensing member portion moves away from the ice tray to a position indicative of a lowered ice level, said ice level sensing member including an elongated fingerlike resilient projection extending generally radially from said horizontal axis, the distal end of said resilient projection engaging a portion of said housing so as to apply a biasing force to the sensing member at least when at said predetermined position indicative of the maximum raised ice level, said biasing force tending to move the said sensing member portion away from the ice tray toward a lowermost position.

2. An automatic ice cube maker according to claim 1, wherein the resilient projection constitutes an integral portion of the sensing member, the sensing member being in the form of an elongated bail formed of molded plastic material having end portions located on said horizontal axis and a curved intermediate portion radially spaced from said horizontal axis, the resilient projection radially extending from one of said end portions.

3. An automatic ice cube maker according to claim 1, wherein said resilient fingerlike projection is generally linear when in an unflexed condition, and wherein said distal end is received into and is movable along a vertical channel provided by said engaged portion of said housing.

4. An automatic ice maker for use in the freezer compartment of a domestic refrigerator comprising:

a rectanglular housing having a generally open top and bottom defined by a front wall, a rear wall, and a pair of opposed sidewalls;

a compartmented ice tray having a top side constituted by a plurality of ice cube shaped pockets for receiving water to be frozen, the ice tray being horizontally mounted within the walls of the housing for movement between an upright ice making position and an inverted ice dumping position;

an electrically energized drive means connected to the ice tray for moving the ice tray between its upright and inverted positions;

a control circuit for energizing the drive means; and a movable ice level sensing member in the form of an elongated one piece bail formed of plastic material, the bail being located below the ice tray, the bail having end portions located on a horizontal axis and a curved intermediate portion radially spaced from the horizontal axis, one end of the bail, constituting a rear end, being pivotally mounted to a portion of the rear wall of the housing, the other end of the bail, constituting a front end, being pivotally mounted to a portion of the front wall of the housing, the pivotally mounted bail being capable of oscillatory movement on said horizontal axis, the intermediate portion being movable away from the ice tray toward a lowermost position and being movable toward the ice tray to an uppermost position, said bail including as an integral portion thereof a projection located at the said front end of the bail and radially spaced from said horizontal axis wherein said projection moves along a curved path as the intermediate portion of the bail moves between its uppermost and lowermost positions, said projection having a distal end portion that extends into a curved groove of predetermined width, the groove corresponding in curvature to said curved path, said curved groove being provided in a face portion of said front wall of the housing, said groove including at one end a retaining means for releasably retaining said projection at the said one end of the groove wherein said intermediate portion of the bail can be retained by the retaining means at its uppermost position.

5. An automatic ice maker according to claim 4, including a manually grippable handle portion extending from the front end of the bail and forming an integral portion thereof, the handle being manually moved by the user to move the said projection in to and out of engagement with the retaining means wherein the user can releasably lock the bail at and unlock the bail from its uppermost position.

6. An automatic ice maker according to claim 4, wherein the retaining means is constituted by a reduced width portion of said groove, free movement of the distal end of the projection being interfered with by said reduced width portion of the groove so as to retain said distal end generally at the location of the reduced width portion until said projection is manually moved passed the retaining means by the user.

7. An automatic ice maker according to claim 6, wherein the said projection is conically shaped, having a base, and an apex constituting said distal end portion riding in said groove.

* * * * *